US008193740B2

(12) United States Patent
Ueno et al.

(10) Patent No.: US 8,193,740 B2
(45) Date of Patent: Jun. 5, 2012

(54) CONTROLLER FOR DISCHARGE LAMP AND LIGHT SOURCE DEVICE

(75) Inventors: Kazuo Ueno, Hamamatsu (JP); Yoshinobu Ito, Hamamatsu (JP); Takamasa Tanaka, Hamamatsu (JP); Koji Matsushita, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 220 days.

(21) Appl. No.: 12/666,144

(22) PCT Filed: May 1, 2008

(86) PCT No.: PCT/JP2008/058387

§ 371 (c)(1),
(2), (4) Date: Jan. 21, 2010

(87) PCT Pub. No.: WO2009/011163

PCT Pub. Date: Jan. 22, 2009

(65) Prior Publication Data

US 2010/0194309 A1 Aug. 5, 2010

(30) Foreign Application Priority Data

Jul. 13, 2007 (JP) ..... P2007-184906

(51) Int. Cl.
*H05B 37/02* (2006.01)

(52) U.S. Cl. ..... 315/307; 315/105; 315/360

(58) Field of Classification Search ..... 315/105–108, 315/291, 294, 297, 307–308, 360
See application file for complete search history.

(56) References Cited

U.S. PATENT DOCUMENTS

| | | | | |
|---|---|---|---|---|
| 3,919,590 | A * | 11/1975 | Remery et al. | 315/101 |
| 4,438,370 | A * | 3/1984 | Allington | 315/106 |
| 4,742,276 | A * | 5/1988 | Ku | 315/106 |
| 5,150,009 | A * | 9/1992 | Kling et al. | 315/107 |
| 5,530,319 | A | 6/1996 | Adam et al. | |
| 5,939,840 | A * | 8/1999 | Nakagawa et al. | 315/307 |

FOREIGN PATENT DOCUMENTS

| | | |
|---|---|---|
| JP | 56-29359 | 8/1981 |
| JP | 60-29400 | 2/1985 |
| JP | 4-109590 | 4/1992 |
| JP | 4-303597 | 10/1992 |
| JP | H5-027635 | 4/1993 |
| JP | 3064359 | 5/2000 |
| JP | 2002-151009 | 5/2002 |
| WO | 2006/022144 | 3/2006 |
| WO | 2006/087975 | 8/2006 |
| WO | 2006/087976 | 8/2006 |

* cited by examiner

*Primary Examiner* — Tung X Le
(74) *Attorney, Agent, or Firm* — Drinker Biddle & Reath LLP

(57) ABSTRACT

A control circuit for a discharge lamp, which can improve the lighting performance of the discharge lamp while realizing low power consumption, and a light source device are provided. The resistance value of the variable resistor ($R_{C1}$, $R_{C2}$) is not switched to the low resistance (R02) for steady discharge at the fourth time t4, but is switched to the low resistance (R02) at the fifth time t5, after lowering of power supply to the filament. With such control, a change in the lamp impedance is absorbed sufficiently by the variable resistor while power supply to the filament is being lowered and, therefore, destabilization of discharge is reduced and the lighting performance is improved.

4 Claims, 7 Drawing Sheets

*Fig.6*

| | LAMP X | LAMP Y |
|---|---|---|
| POWER CONSUMPTION OF LAMP | 30W | 5.5W |
| DISCHARGE CURRENT | 300mA | 30mA |
| CORRECTION RESISTANCE VALUE (AT TIME OF LIGHTING: R01) | 100Ω | 2kΩ |
| CORRECTION RESISTANCE VALUE (STEADY STATE: R02) | 10Ω | 180Ω |
| POWER CONSUMPTION WITH CORRECTION RESISTANCE (R02) | 0.9W | 0.16W |
| POWER CONSUMPTION WITH CORRECTION RESISTANCE (R01) | 9W | 1.8W |

CONTROLLER FOR DISCHARGE LAMP AND LIGHT SOURCE DEVICE

TECHNICAL FIELD

The present invention relates to a controller for a discharge lamp and a light source device.

BACKGROUND ART

A discharge lamp such as a deuterium lamp is used for a standard light source of various measuring instruments or the like. Techniques related to such a discharge lamp are described in Patent Documents 1, 2, 3 and 4 Such a discharge lamp is provided with: a closed vessel having gas encapsulated therein; a cathode constituted of a filament located in the closed vessel; an anode located in the closed vessel; and an aperture member, which has a first opening positioned on a discharge path between the cathode and the anode.

Moreover, a small discharge lamp is also under development. Discharge lamps described in Patent Documents 5, 6 and 7 disclose relatively small discharge lamps.

Such a discharge lamp is provided with a controller for controlling the lighting thereof. A current-limiting resistor is installed in series with a discharge current circuit in a lighting power source of a discharge lamp in order to correct the negative characteristics of the lamp, although a loss at the resistor simply causes lowering of the efficiency of the power source, without contributing to emission of the lamp at all. When the efficiency of the power source is low, the power consumption increases and a large power source becomes necessary and, therefore, miniaturization of a device becomes difficult.

Therefore, a device can be miniaturized by reducing the current-limiting resistance during steady discharge so as to enhance the efficiency of the power source. It is required to increase the current-limiting resistance only at the time of lighting of a discharge lamp, since a change in the lamp impedance is large immediately after the lighting of a discharge lamp, in other words, during preliminary discharge.

Patent Document 1: Japanese Patent No. 3064359

Patent Document 2: Japanese Published Examined Patent Application No. S56-29359

Patent Document 3: Japanese Published Unexamined Patent Application No. H4-303597

Patent Document 4: U.S. Pat. No. 5,530,319

Patent Document 5: International Publication WO2006/022144

Patent Document 6: International Publication WO2006/087975

Patent Document 7: International Publication WO2006/087976

DISCLOSURE OF THE INVENTION

Problems to be Solved by the Invention

However, it was observed that the discharge lamp went out despite discharge being switched from preliminary discharge to main discharge, when the current-limiting resistance was switched to low resistance.

The present invention has been made in view of such a problem, and it is an object thereof to provide: a controller for a discharge lamp, which can improve the lighting performance of a discharge lamp while realizing low power consumption; and a light source device.

Means for Solving the Problem

In order to solve the problem described above, a discharge lamp, to which a controller for a discharge lamp according to the present invention is applied, is provided with: a closed vessel having gas encapsulated therein; a cathode constituted of a filament located in the closed vessel; an anode located in the closed vessel; and an aperture member, which has a first opening positioned on a discharge path between the cathode and the anode.

A controller for a discharge lamp according to the present invention is a controller for controlling the discharge lamp, including: a variable resistor, which is interposed between the anode and a power source and has a resistance value that can be switched between a high resistance value and a low resistance value and is set to the low resistance value during steady discharge; and control means. Here, regarding a first time, a second time, a third time, a fourth time and a fifth time numbered with the elapse of time, the control means starts power supply to the filament at the first time, applies main voltage from the power source to the anode in a state where the resistance value of the variable resistor is set to the high resistance value at the second time, starts application of trigger voltage for preliminary discharge to the anode or the aperture member in a state where the resistance value of the variable resistor is set to the high resistance value at the third time, lowers power supply to the filament at the fourth time without setting the resistance value of the variable resistor to the low resistance value, and sets the resistance value of the variable resistor to the low resistance value at the fifth time.

It is to be noted that a high resistance value and a low resistance value are relative values of resistance.

With such a controller, by supplying electric power to the filament at the first time, thermal electrons are generated at the filament. By applying main voltage and trigger voltage to the anode at the second time and the third time, preliminary discharge occurs between the cathode and the aperture member and between the cathode and the anode. At this time, since the resistance value of the variable resistor is high resistance, a change in the lamp impedance is absorbed by the variable resistor and discharge can be continued in a stable manner. When preliminary discharge ends, discharge is immediately shifted to main discharge. When main discharge occurs, a large number of thermal electrons flow from the cathode to the anode in a stable manner and, therefore, the quantity of thermal electrons to be generated at the filament may be decreased from the quantity at the start of discharge. Therefore, power supply to the filament is lowered so as to reduce the power consumption.

The present inventors have found that a change in power supply to the filament causes a change in the lamp impedance. That is, when power supply to the filament is lowered, discharge becomes unstable and the discharge lamp goes out. Therefore, the resistance value of the variable resistor is not switched to low resistance for steady discharge at the fourth time, but is switched to low resistance at the fifth time, after lowering of power supply to the filament. With such control, a change in the lamp impedance is absorbed sufficiently by the variable resistor while power supply to the filament is being lowered and, therefore, destabilization of discharge is reduced and the lighting performance is improved.

Moreover, since the variable resistor is set to low resistance during steady discharge so as to decrease the power consumption and power supply to the filament is also lowered, it becomes possible to reduce the power consumption remarkably while improving the lighting performance.

Moreover, the variable resistor described above is characterized by including: a main resistor connected in series between a first terminal and a second terminal of the variable resistor; a transistor and a first auxiliary resistor, which are connected in series between the first terminal and the second terminal and in parallel with the main resistor; a second auxiliary resistor and a capacitor, which are connected in series between the first terminal and the second terminal and in parallel with the main resistor; and a Zener diode, which is connected in parallel with the capacitor and has a cathode connected with a control terminal of the transistor and an anode connected with the second terminal.

With a variable resistor having such a structure, when main discharge is started and electric current to be supplied to the anode of the discharge lamp starts flowing into the main resistor, the combined resistance value of the variable resistor between the first terminal and the second terminal gradually lowers with the elapse of time and ends up a low resistance value necessary for steady discharge. With this variable resistor, since the resistance value changes smoothly in a continuous manner, a change in the anode voltage at the time of switching of resistance becomes smooth and the lighting performance is further improved.

A light source device according to the present invention includes the controller for a discharge lamp described above and a discharge lamp, and can reduce the power consumption thereof while improving the lighting performance of the discharge lamp.

EFFECT OF THE INVENTION

With a controller for a discharge lamp and a light source device of the present invention, it is possible to reduce the power consumption thereof while improving the lighting performance of a discharge lamp.

BRIEF DESCRIPTION OF THE DRAWINGS

FIG. 6 is a table for illustrating: power consumption of a discharge lamp; a discharge current; a correction resistance value (at the time of lighting: R01); a correction resistance value (R02); power consumption in a case where the correction resistance (R02) is used; and power consumption in a case where the correction resistance (R01) is used.

DESCRIPTION OF SYMBOLS

AN: Anode
CA: Cathode
$R_{C1}$, $R_{C2}$: Current-limiting resistor (Variable resistor)
AP: Aperture Member
SH: Shield Electrode

BEST MODES FOR CARRYING OUT THE INVENTION

The following description will explain a controller for a discharge lamp according to an embodiment. Identical reference symbols are used for identical elements, and overlapping description is omitted. It is to be noted that a light source device is constructed by connecting a controller (control means) with a discharge lamp 1.

Figure 1:
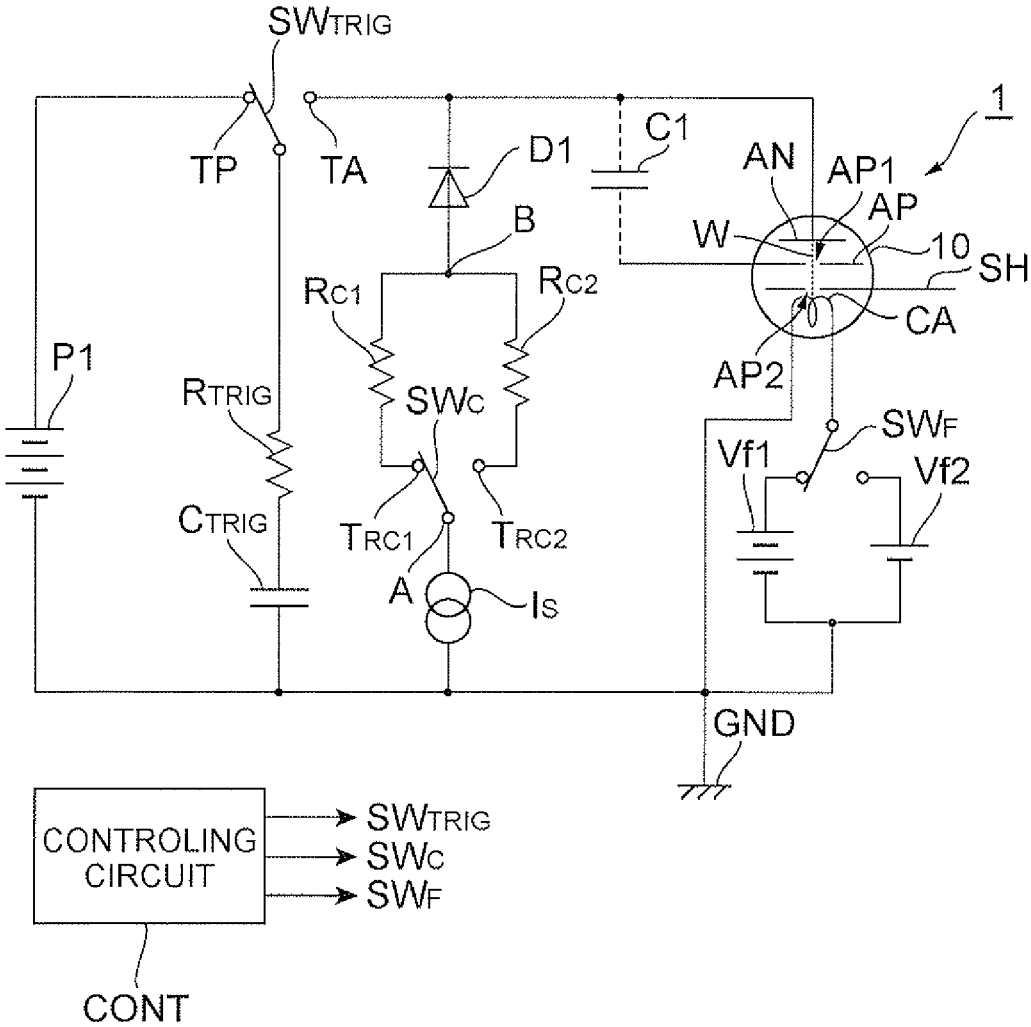
FIG. 1 is a circuit diagram of a light source device according to an embodiment.

FIG. 1 is a circuit diagram of a light source device according to an embodiment.

The discharge lamp 1 is a conventionally known ordinary discharge lamp and is described as a small discharge lamp in, for example, the Patent Documents 5 to 7 described above. A known form of a discharge lamp is a side-on type which outputs light from the side face of a closed vessel or a head-on type which outputs light from the top face of a closed vessel, and a discharge lamp is generally made of glass.

The discharge lamp 1 is provided with: a closed vessel 10 having gas for discharge encapsulated therein; a cathode CA constituted of a filament located in the closed vessel 10; an anode AN located in the closed vessel 10; and an aperture member (discharge control unit) AP, which has a first opening AP1 positioned on a discharge path W between the cathode CA and the anode AN. In the vicinity of the aperture member AP1, encapsulated gas is excited, causing emission. A known gas to be encapsulated in the closed vessel 10 is rare gas, mercury gas or deuterium gas. A discharge lamp of the present example is a deuterium lamp. A deuterium lamp generates a continuous spectrum in the ultraviolet region by discharge of deuterium gas and is used for analytical instruments or the like.

In the closed vessel 10, a shield electrode SH having a rectangular second opening AP2 is provided so as to surround the filament. The aperture member AP and the shield electrode SH are made of metal such as aluminum or stainless steel, and the electric potential of the shield electrode SH is set to a ground potential or a floating potential. Thermal electrons generated at the filament travel through the second opening AP2 of the shield electrode SH and the first opening AP1 of the aperture member AP in order of precedence, and are collected at the anode AN. The second opening AP2 of an actual shield electrode SH is positioned in a manner such that the penetration axis thereof is perpendicular to the penetration axis of the first opening AP1 of the aperture member AP, and thermal electrons generated at the filament enter the opening AP1 of the aperture member AP while traveling in an arc.

In a controller for a discharge lamp, one end of the filament constituting the cathode CA is connected with a ground potential GND, and the other end is connected with a heater power source Vf1 or Vf2 via a selector switch $SW_F$. The selector switch $SW_F$ connects the power source Vf1 with the cathode CA when connected to a terminal Tf1, and connects the power source Vf2 with the cathode CA when connected to a terminal Tf1. Electric current flowing from the heater power source Vf1 is supplied to the cathode CA when the selector switch $SW_F$ is connected with the heater power source Vf1 by a command from a control circuit CONT, and electric current flowing from the heater power source Vf2 is supplied to the cathode CA when the selector switch $SW_F$ is connected with the heater power source Vf2. The voltage of the heater power source Vf1 is set higher than the voltage of the heater power source Vf2.

In the controller for a discharge lamp, the anode AN is connected with a main power source (current source Is) via a current-limiting resistor (correction resistor) $R_{C1}$ or $R_{C2}$. A diode D1 to which forward bias is to be applied is interposed between the current source Is and the anode AN. The diode D1 may be positioned in an upstream region of the current-limiting resistor $R_{C1}$ or $R_{C2}$.

Which of the current-limiting resistors is to be applied is decided by a main bias selector switch $SW_C$. The current source Is and the anode AN are connected with each other via the resistor $R_{C1}$ when the selector switch $SW_C$ is connected to a terminal $T_{RC1}$, and the current source Is and the anode AN are connected with each other via the resistor $R_{C2}$ when the selector switch $SW_c$ is connected to a terminal $T_{RC2}$. The resistance value of the current-limiting resistor $R_{C1}$ is set high, and the resistance value of the current-limiting resistor $R_{C2}$ is set low. A resistor group composed of the current-limiting resistor $R_{C1}$ and the current-limiting resistor $R_{C2}$ constitutes a variable resistor. A node at the high potential side of the variable resistor is denoted by A, and a node at the low potential side is denoted by B.

The controller for a discharge lamp is provided with a trigger power source P1. A trigger resistor $R_{TRIG}$ and a capacitor $C_{TRIG}$ are connected in parallel with the trigger power source P1. When a selector switch for trigger voltage application $SW_{TRIG}$ is connected to a terminal TP, electric charges flow from the trigger power source P1 to the capacitor $C_{TRIG}$, and the capacitor $C_{TRIG}$ is charged. Next, when the selector switch $SW_{TRIG}$ is connected to a terminal TA, the charged capacitor $C_{TRIG}$ is connected with the anode AN and with the aperture member AP, and trigger voltage is applied to the anode AN and the aperture member AP. It is to be noted that a capacitor C1 is interposed between the terminal TA and the aperture member AP when necessary, so that peak voltage included in trigger voltage flows into the aperture member AP as an alternating-current component. Such a structure enables sufficient preliminary discharge.

Switching behavior of each selector switch $SW_F$, $SW_C$, $SW_{TRIG}$ is achieved by a control signal to be output from the control circuit CONT to the selector switch $SW_F$, $SW_C$, $SW_{TRIG}$. The selector switch $SW_F$, $SW_C$, $SW_{TRIG}$ can be constituted of, for example, a relay or a pair of transistors.

The resistance value of the variable resistor described above, which is composed of the current-limiting resistor $R_{C1}$ and the current-limiting resistor $R_{C2}$, can be switched between a high resistance value (R01) and a low resistance value (R02). The resistance value of this variable resistor is set to the low resistance value (R02) during steady discharge. It is to be noted that a high resistance value and a low resistance value are relative values of resistance.

The control circuit CONT controls the lighting of the discharge lamp 1 as follows.

Figure 2:
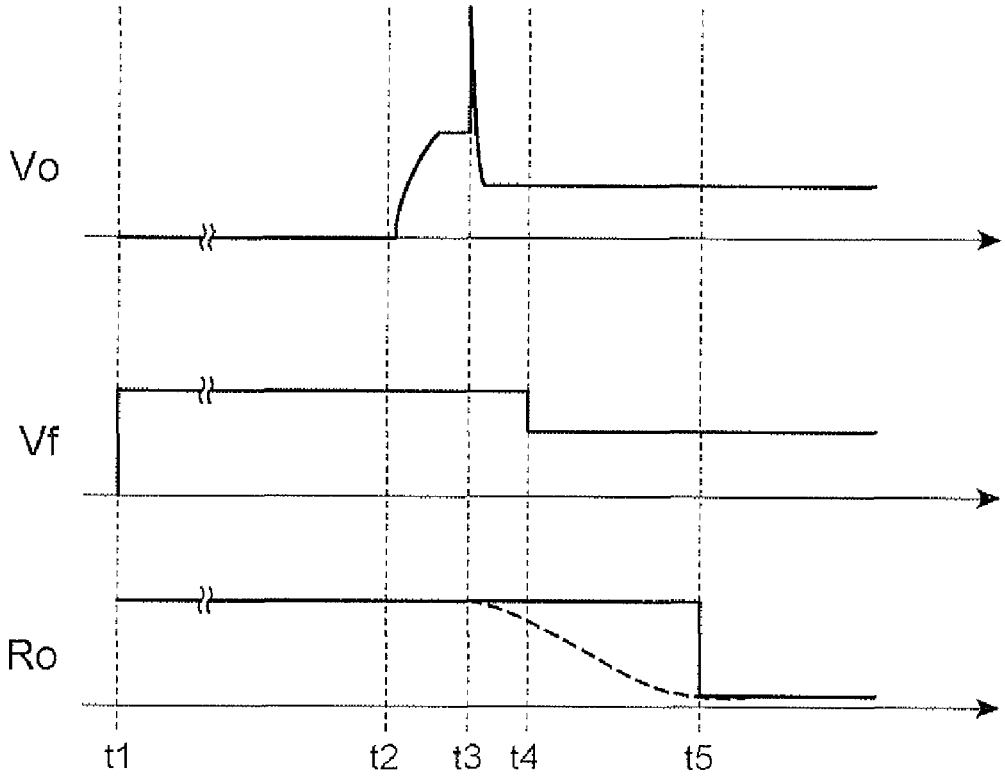
FIG. 2 is a timing chart of each voltage at the time of lighting.

FIG. 2 is a timing chart of each voltage at the time of lighting. It is to be assumed that a first time t1, a second time t2, a third time t3, a fourth time t4 and a fifth time t5 are numbered with the elapse of time. $V_0$ denotes a voltage between the anode AN and the ground GND, Vf denotes a voltage to be applied to the ends of the filament of the cathode CA, and $R_0$ denotes a resistance value of the variable resistor ($R_{C1}$, $R_{C2}$).

By connecting the switch $SW_F$ to the terminal Vf1, the filament is connected with the power source Vf1 and power supply to the filament is started at the first time t1, and such a state is continued. By connecting the switch $SW_C$ to the terminal $T_{RC1}$, main voltage ($V_0$) is applied from the power source (Is) to the anode AN in a state where the resistance value of the variable resistor ($R_{C1}$, $R_{C2}$) is set to the high resistance value ($R_0$=R01) at the second time t2. By connecting the charged capacitor $C_{TRIG}$ with the terminal TA via the switch $SW_{TRIG}$ in a state where the resistance value of the variable resistor ($R_{C1}$, $R_{C2}$) is set to the high resistance value ($R_0$=R01) at the third time t3, application of trigger voltage for preliminary discharge ($V_0$) to the anode AN and the aperture member AP is started.

By connecting the switch $SW_F$ to the terminal Tf2 at the fourth time t4 without setting the resistance value of the variable resistor ($R_{C1}$, $R_{C2}$) to the low resistance value ($R_0$=R02), the filament is connected with the power source Vf2 (voltage lower than Vf1) and power supply (voltage Vf) to the filament is lowered. By connecting the switch $SW_C$ to the terminal $T_{RC2}$, the resistance value of the variable resistor ($R_{C1}$, $R_{C2}$) is set to the low resistance value ($R_0$=R02) at the fifth time t5. It is to be noted that the voltage $V_0$ lowers at the third time t3.

With such a controller, thermal electrons are generated at the filament by supplying electric power to the cathode CA (filament) at the first time t1. Preliminary discharge occurs between the cathode CA and the aperture member AP and between the cathode CA and the anode AN by applying main voltage and trigger voltage to the anode AN at the second time t2 and the third time t3. At this time, since the resistance value of the variable resistor ($R_{C1}$, $R_{C2}$) is set to the high resistance (R01), a change in the lamp impedance is absorbed by the variable resistor ($R_{C1}$, $R_{C2}$) and discharge can be continued in a stable manner.

When preliminary discharge ends, discharge is immediately shifted to main discharge. When main discharge occurs, a large number of thermal electrons flow from the cathode CA to the anode AN in a stable manner and, therefore, the quantity of thermal electrons to be generated at the filament may be decreased from the quantity at the start of discharge. Therefore, power supply to the filament is lowered so as to reduce the power consumption in the present embodiment.

It is to be noted that the resistance value between the ends of the variable resistor ($R_{C1}$, $R_{C2}$) may be switched to the low resistance (R02) at the time t5, or may start lowering gradually at the time t3 and end up being switched to the low resistance (R02) at the time t5.

In the present embodiment, the resistance value of the variable resistor ($R_{C1}$, $R_{C2}$) is not switched to the low resistance (R02) for steady discharge at the fourth time t4, but is switched to the low resistance (R02) at the fifth time t5, after lowering of power supply to the filament. With such control, a change in the lamp impedance is absorbed sufficiently by the variable resistor while power supply to the filament is being lowered and, therefore, destabilization of discharge is reduced and the lighting performance is improved.

Moreover, since the variable resistor is set to the low resistance (R02) during steady discharge so as to decrease the power consumption and power supply (voltage Vf) to the filament is also lowered, it becomes possible to reduce the power consumption remarkably while improving the lighting performance.

A light source device according to the present invention is provided with the controller for a discharge lamp described above and a discharge lamp, and can reduce the power consumption thereof while improving the lighting performance of the discharge lamp.

Figure 3:
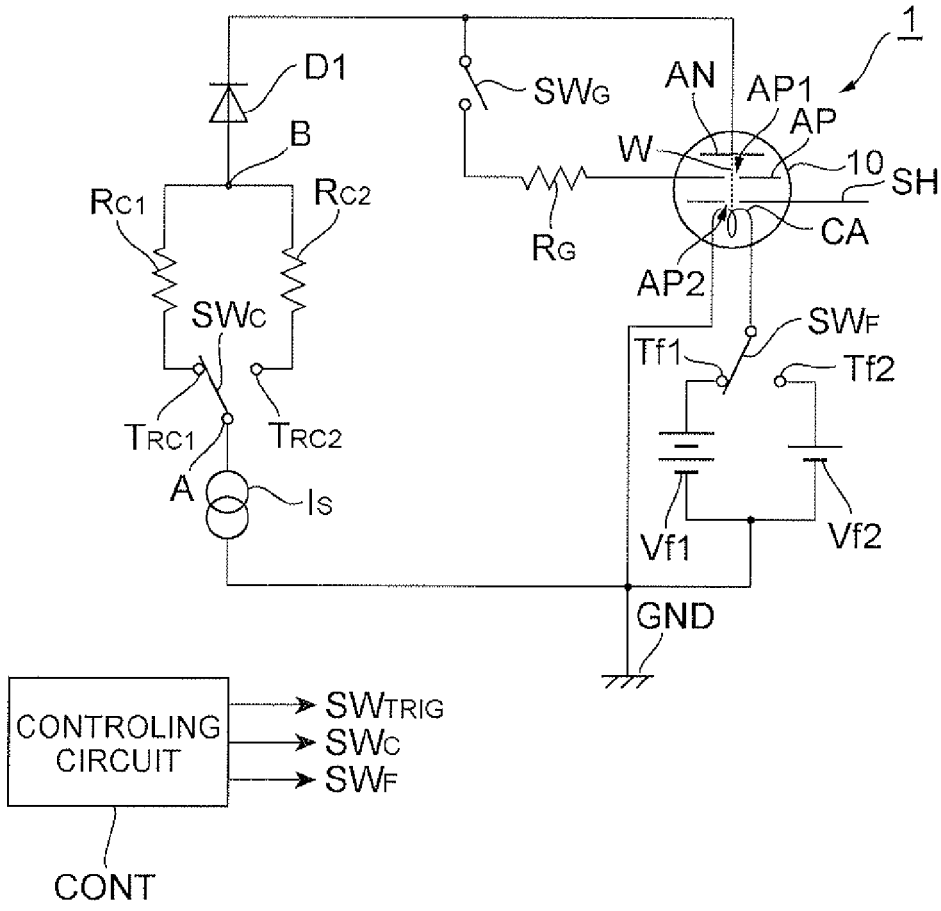
FIG. 3 is a circuit diagram of a controller for a discharge lamp according to another structure.

FIG. 3 is a circuit diagram of a controller for a discharge lamp according to another structure.

In the present example, a resistor RG and a connection switch for trigger application $SW_G$ are connected in series between the anode AN and the aperture member SH instead of the trigger voltage generator circuit (P1, $C_{TRIG}$, $R_{TRIG}$, $SW_{TRIG}$) illustrated in FIG. 1, and other structures are the same as that described in FIG. 1.

Figure 4:
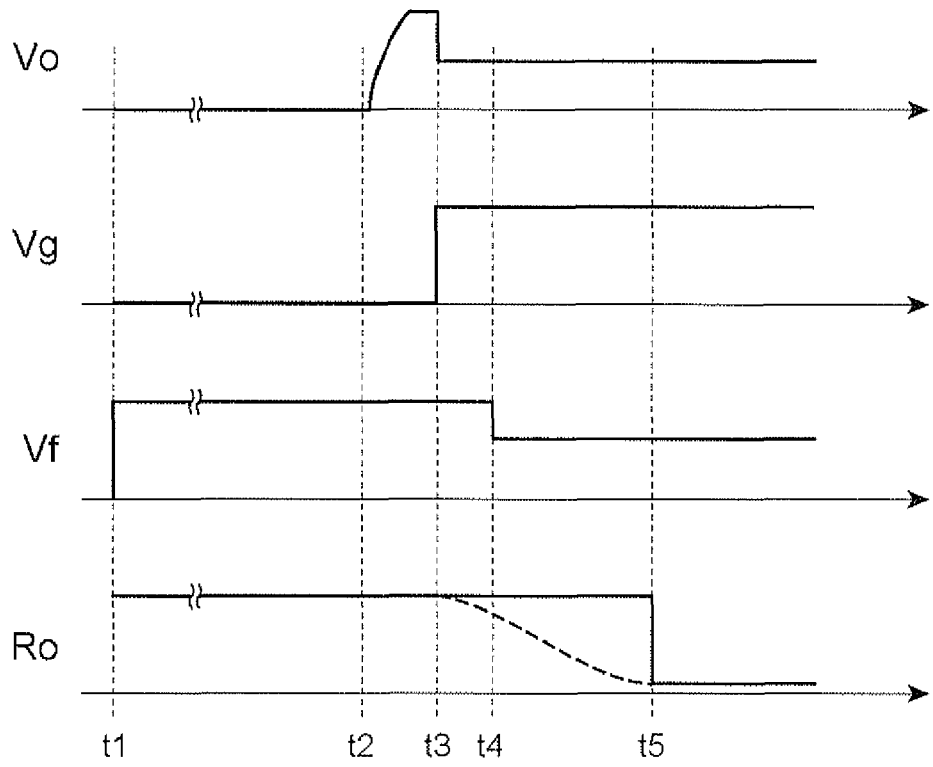
FIG. 4 is a timing chart of each voltage at the time of lighting of the light source device of FIG. 3.

FIG. 4 is a timing chart of each voltage at the time of lighting of the light source device of FIG. 3. $V_0$ denotes a voltage between the anode AN and the ground GND, Vg denotes a voltage between the aperture member AP and the ground potential GND, Vf denotes a voltage to be applied to the ends of the filament of the cathode CA, and $R_0$ denotes a resistance value of the variable resistor ($R_{C1}$, $R_{C2}$). The behavior at the times t1, t2, t4 and t5 is the same as that explained with reference to FIG. 2. In the present example, the switch $SW_G$ is connected at the third time t3, so that the trigger voltage Vg to be applied to the aperture member AP rises. With such a structure, trigger voltage is applied to the aperture member AP, preliminary discharge is achieved, and main discharge is achieved immediately.

That is, by connecting the switch $SW_F$ to the terminal Tf2 at the fourth time t4 without setting the resistance value of the variable resistor ($R_{C1}$, $R_{C2}$) to the low resistance value ($R_0$=R02), the filament is connected with the low voltage power source Vf2 and power supply (voltage Vf) to the filament is lowered. By connecting the switch $SW_C$ to the terminal $TR_{C2}$, the resistance value of the variable resistor ($R_{C1}$, $R_{C2}$) is set to the low resistance value ($R_0$=R02) at the fifth time t5.

In the present embodiment, the resistance value of the variable resistor ($R_{C1}$, $R_{C2}$) is not switched to the low resistance (R02) for steady discharge at the fourth time t4, but is switched to the low resistance (R02) at the fifth time t5, after lowering of power supply to the filament. With such control, a change in the lamp impedance is absorbed sufficiently by the variable resistor while power supply to the filament is being lowered and, therefore, destabilization of discharge is reduced and the lighting performance is improved.

Moreover, since the variable resistor is set to the low resistance (R02) during steady discharge so as to decrease the power consumption and power supply (voltage Vf) to the filament is also lowered, it becomes possible to reduce the power consumption remarkably while improving the lighting performance. It is to be noted that trigger voltage may be applied only to the anode AN, applied only to the aperture member AP, or applied to both.

Figure 5:
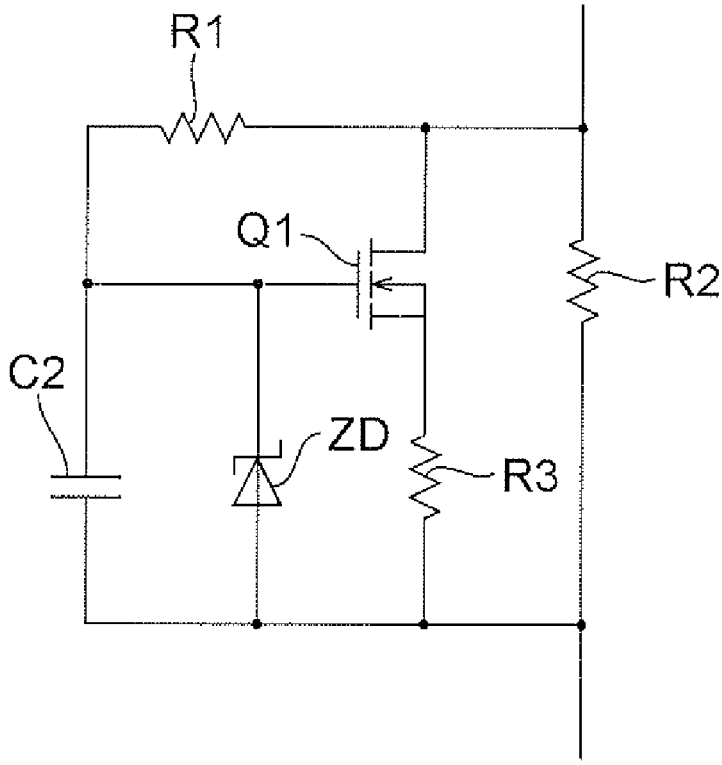
FIG. 5 is a circuit diagram for illustrating an example of a variable resistor.

FIG. 5 is a circuit diagram for illustrating an example of the variable resistor described above.

The variable resistor described above is provided with: a main resistor R2 connected in series between the first terminal A and the second terminal B of the variable resistor; a field-effect transistor Q1 and a first auxiliary resistor R3, which are connected in series between the first terminal A and the second terminal B and in parallel with the main resistor R2; a second auxiliary resistor R1 and a capacitor C2, which are connected in series between the first terminal A and the second terminal B and in parallel with the main resistor R2; and a Zener diode ZD, which is connected in parallel with the capacitor C2 and has a cathode connected with a control terminal (gate) of the transistor Q1 and an anode connected with the second terminal B.

With a variable resistor having such a structure, the resistance value starts lowering gradually at the third time t3 and ends up low resistance at the time t5 as illustrated by dotted lines in FIGS. 2 and 4.

That is, when main discharge is started at the time t3 and electric current to be supplied to the anode AN of the discharge lamp 1 starts flowing into the main resistor R2, the combined resistance value of the variable resistor between the first terminal A and the second terminal B gradually lowers with the elapse of time and ends up a low resistance value necessary for steady discharge. In this variable resistor, the resistance value changes smoothly in a continuous manner and, therefore, a change in the anode voltage at the time of switching of resistance becomes smooth and the lighting performance is further improved.

When flow to the main resistor R2 starts, a potential difference occurs between the ends thereof, the capacitor C2 is charged via the auxiliary resistor R1, and the electric potential of the upstream side of the capacitor C2 becomes a positive potential. When the positive potential is given to the gate of the field-effect transistor Q1 of an N channel, the transistor Q1 becomes conductive and electric current also flows into the transistor R3. That is, the combined resistance of the resistor R2 and the resistor R3 lowers. Next, when electric current further flows and a potential difference between the terminal A and the terminal B becomes larger, electric current also starts flowing into the Zener diode ZD, and the value of the combined resistance including the resistors R2, R3 and R1 further lowers and converges on a constant value. In a steady state, discharge current becomes a constant value.

As described above, the filament voltage changes after the lamp is lighted and before a correction resistance value lowers to a value of a steady state.

FIG. 6 is a table for illustrating: power consumption of a discharge lamp; a discharge current; a correction resistance value (at the time of lighting: R01); a correction resistance value (R02); power consumption in a case where the correction resistance (R02) is used; and power consumption in a case where the correction resistance (R01) is used. A lamp X is a large discharge lamp and a lamp Y is a small discharge lamp. It can be found that the power consumption is lowered remarkably by switching a correction resistance (current-limiting resistance) regarding a discharge lamp of either type. An IC or a computer can also be used as the control means of the present invention.

Figure 7:
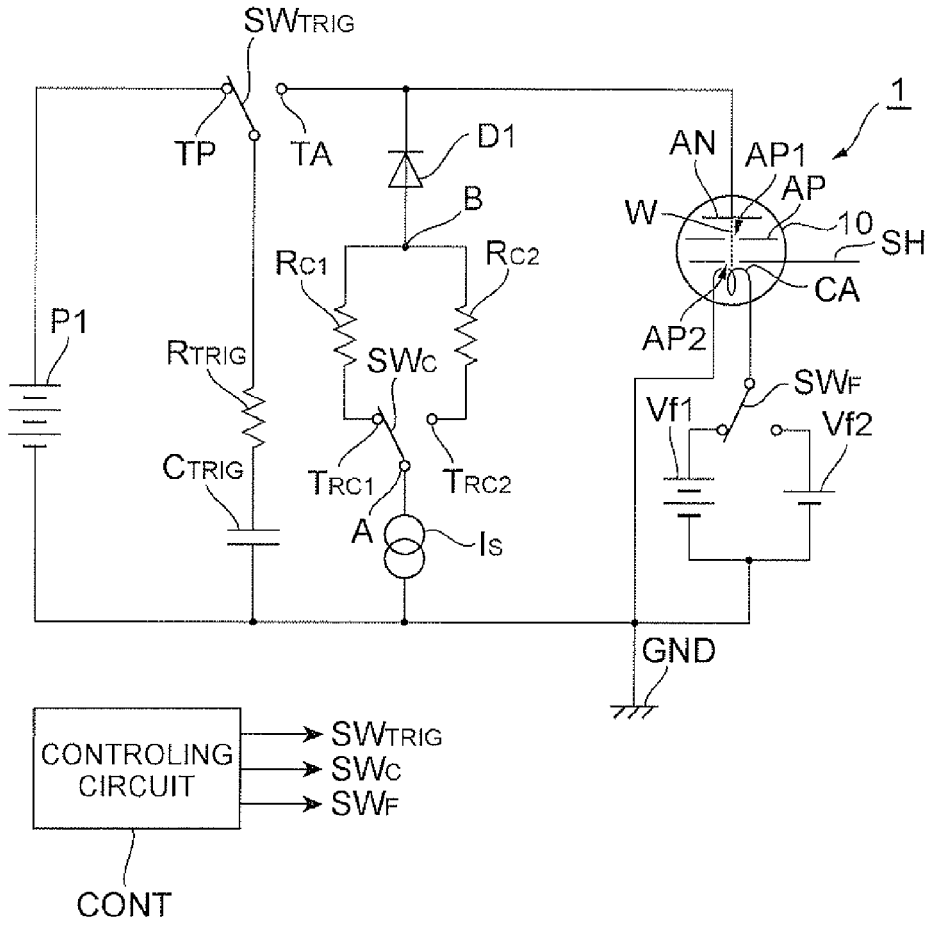
FIG. 7 is a circuit diagram of a light source device according to another embodiment.

FIG. 7 is a circuit diagram of a light source device of an embodiment wherein trigger voltage is applied only to the anode AN.

The light source device illustrated in FIG. 7 is obtained by deleting the capacitor C1 from the light source device illustrated in FIG. 1, and is not constructed to apply trigger voltage to the aperture member AP. Lighting behavior in such a case will be explained with reference to FIG. 2 again.

FIG. 2 is a timing chart of each voltage at the time of lighting. It is to be assumed that a first time t1, a second time t2, a third time t3, a fourth time t4 and a fifth time t5 are numbered with the elapse of time. $V_0$ denotes a voltage between the anode AN and the ground GND, Vf denotes a voltage to be applied to the ends of the filament of the cathode CA, and $R_0$ denotes a resistance value of the variable resistor ($R_{C1}$, $R_{C2}$).

By connecting the switch $SW_F$ to the terminal Vf1, the filament is connected with the power source Vf1 and power supply to the filament is started at the first time t1, and such a state is continued. By connecting the switch $SW_C$ to the terminal $TR_{C1}$, main voltage ($V_0$) is applied from the power source (Is) to the anode AN in a state where the resistance value of the variable resistor ($R_{C1}$, $R_{C2}$) is set to the high resistance value ($R_0$=R01) at the second time t2. By connecting the charged capacitor $C_{TRIG}$ with the terminal TA via the switch $SW_{TRIG}$ in a state where the resistance value of the variable resistor ($R_{C1}$, $R_{C2}$) is set to the high resistance value ($R_0$=R01) at the third time t3, application of trigger voltage for discharge ($V_0$) to the anode AN is started.

By connecting the switch $SW_F$ to the terminal Tf2 at the fourth time t4 without setting the resistance value of the variable resistor ($R_{C1}$, $R_{C2}$) to the low resistance value ($R_0$=R02), the filament is connected with the power source Vf2 (voltage lower than Vf1) and power supply (voltage Vf) to the filament is lowered. By connecting the switch $SW_C$ to the terminal $TR_{C2}$, the resistance value of the variable resistor ($R_{C1}$, $R_{C2}$) is set to the low resistance value ($R_0$=R02) at the fifth time t5. It is to be noted that the voltage $V_0$ lowers at the third time t3.

With such a controller, thermal electrons are generated at the filament by supplying electric power to the cathode CA (filament) at the first time t1. Discharge occurs between the cathode CA and the anode AN by applying main voltage and trigger voltage to the anode AN at the second time t2 and the third time t3. At this time, since the resistance value of the variable resistor ($R_{C1}$, $R_{C2}$) is set to the high resistance (R01), a change in the lamp impedance is absorbed by the variable resistor ($R_{C1}$, $R_{C2}$) and discharge can be continued in a stable manner.

Since a large number of thermal electrons flow from the cathode CA to the anode AN in a stable manner after discharge is shifted to main discharge, the quantity of thermal electrons to be generated at the filament may be decreased from the quantity at the start of discharge. Therefore, power supply to the filament is lowered so as to reduce the power consumption in the present embodiment.

It is to be noted that the resistance value between the ends of the variable resistor ($R_{C1}$, $R_{C2}$) may be switched to the low resistance (R02) at the time t5, or may start lowering gradually at the time t3 and end up being switched to the low resistance (R02) at the time t5.

In the present embodiment, the resistance value of the variable resistor ($R_{C1}$, $R_{C2}$) is not switched to the low resistance (R02) for steady discharge at the fourth time t4, but is switched to the low resistance (R02) at the fifth time t5, after lowering of power supply to the filament. With such control, a change in the lamp impedance is absorbed sufficiently by the variable resistor while power supply to the filament is being lowered and, therefore, destabilization of discharge is reduced and the lighting performance is improved.

Moreover, since the variable resistor is set to the low resistance (R02) during steady discharge so as to decrease the power consumption and power supply (voltage Vf) to the filament is also lowered, it becomes possible to reduce the power consumption remarkably while improving the lighting performance.

A light source device according to the present invention is provided with the controller for a discharge lamp described above and a discharge lamp, and can reduce the power consumption thereof while improving the lighting performance of the discharge lamp.

The invention claimed is:

1. A controller for controlling a discharge lamp provided with:

a closed vessel having gas encapsulated therein;

a cathode constituted of a filament located in the closed vessel;

an anode located in the closed vessel; and an aperture member, which has a first opening positioned on a discharge path between the cathode and the anode, said controller comprising:

a variable resistor, which is interposed between the anode and a power source and has a resistance value that is configured to be switched between a high resistance value and a low resistance value and is set to the low resistance value during steady discharge; and control means capable of performing, regarding a first time, a second time, a third time, a fourth time and a fifth time numbered with the elapse of time, operations of:

starting power supply to the filament at the first time;

applying main voltage from the power source to the anode in a state where the resistance value of the variable resistor is set to the high resistance value at the second time;

starting application of trigger voltage for discharge to the anode or the aperture member in a state where the resistance value of the variable resistor is set to the high resistance value at the third time;

lowering power supply to the filament at the fourth time without setting the resistance value of the variable resistor to the low resistance value; and setting the resistance value of the variable resistor to the low resistance value at the fifth time.

2. The controller for the discharge lamp according to claim 1, wherein the variable resistor comprises:

a main resistor connected in series between a first terminal and a second terminal of the variable resistor;

a transistor and a first auxiliary resistor, which are connected in series between the first terminal and the second terminal and in parallel with the main resistor;

a second auxiliary resistor and a capacitor, which are connected in series between the first terminal and the second terminal and in parallel with the main resistor; and a Zener diode, which is connected in parallel with the capacitor and has a cathode connected with a control terminal of the transistor and an anode connected with the second terminal.

3. A light source device comprising:

the controller for the discharge lamp according to claim 2.

4. A light source device comprising:

The controller for the discharge lamp according to claim 1.

* * * * *